US005715555A

United States Patent [19]

Reber et al.

[11] Patent Number: 5,715,555

[45] Date of Patent: Feb. 10, 1998

[54] SMART LAUNDRY SYSTEM AND METHODS THEREFOR

[75] Inventors: William L. Reber, Schaumburg; Bruce E. Stuckman, Algonquin, both of Ill.; Cary D. Perttunen, Shelby Township, Mich.

[73] Assignee: Motorola Inc., Schaumburg, Ill.

[21] Appl. No.: 527,133

[22] Filed: Sep. 12, 1995

[51] Int. Cl.[6] ..... D06F 33/02

[52] U.S. Cl. ..... 8/158; 68/12.02; 68/12.18; 68/12.19; 68/12.21; 8/159

[58] Field of Search ..... 8/159, 158; 68/12.01, 68/12.02, 12.18, 12.19, 12.12, 12.16, 12.27

[56] References Cited

U.S. PATENT DOCUMENTS 3,478,316 11/1969 Block et al. .
3,876,075 4/1975 Wesner .
4,084,237 4/1978 Beachem et al. .
4,550,246 10/1985 Markman .
4,849,999 7/1989 Humphreys et al. .
5,161,393 11/1992 Payne et al. .
5,388,299 2/1995 Lee .
5,413,841 5/1995 Mahn, Sr. et al. .
5,420,757 5/1995 Eberhardt et al. .

*Primary Examiner*—Frankie L. Stinson
*Attorney, Agent, or Firm*—Bruce E. Stuckman

[57] ABSTRACT

A smart laundry system includes a tag communicating device for reading laundering instructions and water processing information contained in an electronic tag attached to a material item while the material item is within a laundry machine. A controller controls the laundry machine in accordance with the laundering instructions. A water processing system processes waste water produced by the laundry machine in accordance with the water processing information to form gray water for use in a subsequent wash. The electronic tag maintains a count of the number of launderings of the material item. An automatic folding and sorting machine folds and sorts the material item based upon folding and sorting instructions stored on the electronic tag. A tag programming device is used to identify, locate, query, and program the electronic tag.

42 Claims, 5 Drawing Sheets

SMART LAUNDRY SYSTEM AND METHODS THEREFOR

FIELD OF THE INVENTION

The present invention relates to methods and systems for laundering wearable and non-wearable material items.

BACKGROUND OF THE INVENTION

In applications where a number of material items, such as clothes, are to be laundered, it is desirable to automatically control one or more settings of a laundry machine to properly launder the items. U.S. Pat. No. 5,388,299 to Lee discloses a washing control system having an information sensing part attached on an upper, front surface of a washing machine body. The information sensing part reads washing information stored on information media attached to articles of clothing. The washing information is stored in the form of either a bar code or a recording on a magnetic tape.

To read the washing information, each information medium attached to an article of clothing is made to come close to the information sensing part. For example, using a bar-coded information medium, each information medium is manually applied to a bar code reader to sense the information stored therein.

The task of manually reading each information medium, one by one, before putting the clothes in the washing machine introduces additional labor to the process of washing the clothes. On occasion, more than one attempt may be required to successfully read a bar code on an article of clothing, as is witnessed from the use of bar code readers in supermarkets and department stores. Further, this approach prohibits an entire load of clothes to be substantially simultaneously placed into the washing machine, i.e., dumped into the washing machine.

It is also known that the generation of waste water from laundering processes has a significant environmental impact in terms of both waste volume and contaminant loading. In "Demonstration of Ultrafiltration and Carbon Adsorption for Treatment of Industrial Laundering Wastewater," EPA-600/2-78-177 by Kleper et al., it is reported that industrial laundry waste water can be 3 to 20 times higher in suspended solids than average domestic sewage.

To treat laundry waste water, Kleper et al. proposed the use of a spiral-wound ultrafiltration module in combination with an activated carbon adsorption system. Kleper et al. reported that an additional prefiltration system was needed in addition to the above combination to prevent plugging of the spiral-wound modules by lint. It is further reported that severe membrane surface fouling occurred and difficulty in recovering membrane flux using standard detergent cleaning procedures was encountered using this system.

Kleper et al. provide data illustrating that industrial laundering effluents have both flow and composition which are highly variable over both short-term operation (minutes to hours) and long-term operation (days to months).

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

DETAILED DESCRIPTION OF A PREFERRED EMBODIMENT

Embodiments of the present invention advantageously read laundering instructions contained in electronic tags attached to a plurality of material items. The laundering instructions are all read while the material items are within a laundry machine. As a result, the laundering instructions can be obtained for an entire load of clothes which are substantially simultaneously loaded into the laundry machine. Hence, users of embodiments of the present invention are not required to expend additional effort to load the clothes one-by-one when utilizing the laundry machine control system.

Other embodiments of the present invention update a count stored in the electronic tag, the count indicative of the number of times the material item has been laundered. This allows a consumer to track the lifetime of the material item (similar to tracking tire mileage, for example) in terms of the number of laundering cycles. The use of an updatable count in the electronic tag is advantageous in motivating manufacturers to address the lifetime of material items which they produce.

In another embodiment of the present invention, a water processing system is controlled using information read from the electronic tag. In particular, waste water produced by washing a material item is processed for reuse in a subsequent wash based upon the information read from the electronic tag. By anticipating the contamination type and level in waste water produced by washing the material item, the performance and efficiency of the water processing system can be maintained for effluent variations.

Figure 1:
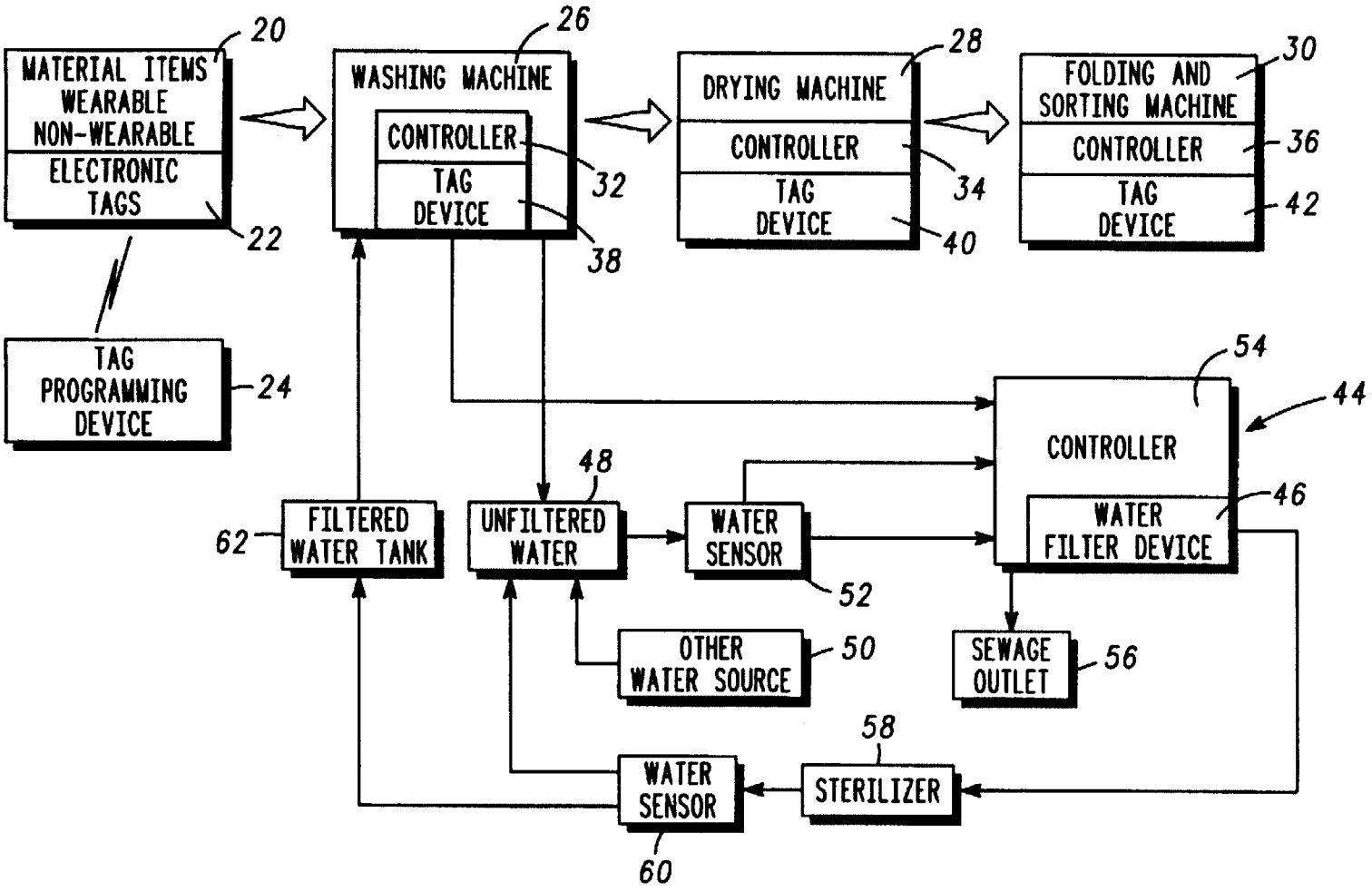
FIG. 1 is a block diagram of an embodiment of a smart laundry system in accordance with the present invention.

FIG. 1 is a block diagram of a preferred embodiment of a laundry system in accordance with the present invention. The laundry system is utilized to launder a plurality of material items 20. The material items 20 may be wearable items such as articles of clothing, garments, uniforms, or gloves, or non-wearable items such as drapes, curtains, towels, mops, or mats. For these types of material items, the laundry system is utilized to wash, dry, sort, and/or fold the material items 20.

Other types of non-wearable items include plates, dishes, silverware, etc. Here, the laundry system comprises a dishwasher utilized to wash and dry the material items 20. Further non-wearable items contemplated for laundering using a smart laundry system in accordance with the present invention include dental tools and surgical tools.

For the purpose of the description herein, the terms "launder" and "laundering" of a material item should be construed as inclusive of one or more of washing, drying, sorting, and folding the material item. Further, the terms "launder" and "laundering" should not be limited to laundering of fabrics.

Each of the material items 20 has an electronic tag 22 attached thereto. The electronic tag 22 can be incorporated within an element of the material item 20, such as within a button on an article of clothing. Alternatively, the electronic tag 22 can be in a generic form for affixing to a variety of different material items. The electronic tag 22 is programmed to store identification information for the material item 20, laundering instructions, water processing instructions, and a count indicative of a number of times the material item 20 has been laundered. For a wearable material item, the laundering instructions can include washing instructions, drying instructions, folding instructions, and sorting instructions.

The electronic tag 22 can be either preprogrammed with the various information, or programmed by a tag programming device 24. The tag programming device 24 is operative to read and/or write information stored within the electronic tag 22, such as identification information, laundering instructions, and a laundering count for the material item 20. The tag programming device 24 can be utilized to identify the material items 20 and/or locate each material item 20 within the laundry system. In one embodiment of the present invention, the tag programming device 24 is external to the laundry system, and in the form of a portable unit.

The material items 20 having programmed electronic tags 22 attached thereto are placed into a laundry machine within the laundry system. For wearable material items, the laundry machine can be in the form of a washing machine 26, a drying machine 28, or an automatic folding and sorting machine 30. For non-wearable material items, such as dishes, the laundry machine can be in the form of a dishwasher. For surgical and dental tools, the laundry machine is in the form of a tool sterilizer. In general, the above-described laundry machines can be intended for either personal use or commercial use.

Each laundry machine has a controller which controls its operation. In the embodiment of FIG. 1, the washing machine 26 is controlled by a controller 32, the drying machine is controlled by a controller 34, and the automatic folding and sorting machine is controlled by a controller 36. Each controller 32, 34, and 36 provides a number of controls having a number of control positions or settings.

A tag communicating device is embedded within each laundry machine in the laundry system. Each tag communicating device is utilized to communicate information with the electronic tags 22. In the embodiment of FIG. 1, a tag communicating device 38 is embedded within the washing machine 26, a tag communicating device 40 is embedded within the drying machine 28, and a tag communicating device 42 is embedded within the automatic folding and sorting machine 30.

Each tag communicating device 38, 40, and 42 reads laundering instructions contained in the electronic tags 22 while the material items 20 are within the laundry machine. The laundering instructions are examined to ensure that the controls for the laundry machine are set correctly. Further, the laundering instructions are examined to ensure that all of the material items 20 are to be laundered in a similar manner. If the controls are not set correctly, or if substantially different types of material items 20 (e.g. both dark material items and light material items) are within the laundry machine, an alert signal is issued to warn a user of an incorrect setting.

In the embodiment of FIG. 1, the material items 20 are first placed in the washing machine 26. Information contained within the electronic tags 22 are read by the tag communicating device 38 while the material items 20 are within the washing machine 26. The material items 20 are washed by the washing machine 26 in accordance with the washing instructions stored in the electronic tags 22. Examples of the washing instructions include wash water temperature, rinse water temperature, water level, and wash time.

A water processing system 44 is operative to process waste water produced by the washing machine 26 as a result of washing the material items 20. The waste water is processed to produce gray water for reuse in a subsequent wash.

The water processing system 44 includes a water filtration device 46 which receives unfiltered water 48 from an output of the washing machine 26 and/or other sources of gray water 50. The other sources of gray water 50 can include bath or shower water, rain water, and water from melted ice or snow. A water sensor 52 measures the water quality of the unfiltered water 48, and provides a signal representative thereof to a filtration controller 54.

The filtration controller 54 controls the operation of the water filtration device 46 in dependence upon the water quality sensed by the water sensor 52. Further, the filtration controller 54 can direct the unfiltered water 48 to either the water filtration device 46 or a sewage outlet 56 based upon the water quality. In a preferred embodiment, a plurality of water sensors are utilized to sense a number of characteristics of the unfiltered water 48.

The filtration controller 54 controls the operation of the water filtration device 46 in dependence upon information read by the tag communication device 38. For example, waste water produced in washing white-colored items has a higher temperature than waste water produced in washing dark-colored material items. The water filtration device 46 can be suitably controlled in anticipation of the temperature of the waste water. In particular, since the viscosity of water, and hence its filtration characteristic, is dependent upon temperature, the water filtration device 46 can modify at least one of its operational parameters based upon the information to more efficiently filter the waste water. More generally, by communicating water processing information contained in the electronic tags 22 to the filtration controller 54, the water processing system 44 can be suitably controlled to anticipate characteristics of the waste water which is received, and thus improve a filtration efficiency.

In one embodiment, the water filtration device 46 comprises a membrane belt filter such as any of the filters described in U.S. Pat. Nos. 5,292,438, 5,256,288, and 5,259,952 issued to Lee and assigned to Cer-Wat, Inc. These membrane belt filters are advantageous in providing continuous filtration operation without having to stop the system to remove and clean a filter membrane.

It is preferred that the membrane belt filter be controlled in accordance with the disclosure of pending U.S. Application entitled "Methods and Systems for Controlling a Continuous Medium Filtration System" having Ser. No. 08/393,613, filed Feb. 23, 1995, assigned to the same assignee of the present application, and hereby incorporated by reference. The methods and systems disclosed therein are advantageous for filtering effluents with varying flow and composition.

As an alternative to using a moving belt filter, the water filtration device 46 can comprise a removable cartridge filter.

The filtered water produced by the water filtration device 46 is sterilized by a sterilizer 58. The sterilizer 58 can comprise an ultraviolet light device or an ozonation device for disinfecting the water output from the water filtration device 46. In particular, the sterilizer 58 is utilized to remove organic material such as bacteria and viruses from the water applied thereto.

A water sensor 60 measures the water quality of the sterilized water produced by the sterilizer 58. Optionally, the water sensor 60 can directly measure the water quality of the unsterilized, filtered water produced by the water filtration device 46. The water sensor 60 determines if the water quality is sufficient for use in a subsequent wash by the washing machine 26. If so, the water is stored in a filtered water tank 62. If the water quality is inappropriate for a subsequent wash, the water is directed back to the input of the water filtration device 46 for refining in a subsequent filtration and sterilization cycle.

After being washed by the washing machine 26, the material items 20 are placed into the drying machine 28 for removal of water absorbed therein. The tag communicating device 40 reads drying instructions contained in the electronic tags 22 while the material items are within the drying machine 28. Examples of drying instructions include drying temperature and drying time.

After the material items 20 are dried by the drying machine 26, the material items 20 are presented to the automatic folding and sorting machine 30. The automatic folding and sorting machine 30 folds and sorts the material items 20 in accordance with folding and sorting instructions contained in the electronic tags 22 and read by the tag communicating device 42.

The automatic folding and sorting machine 30 can be embodied by an existing folding and sorting machine adapted to modify its folding and/or sorting based upon the folding and sorting instructions. Known folding and sorting machines are disclosed in U.S. Pat. Nos. 4,234,179, 4,238,060, 4,907,699, 4,991,719, 5,125,513, and 5,419,439.

Figure 2:
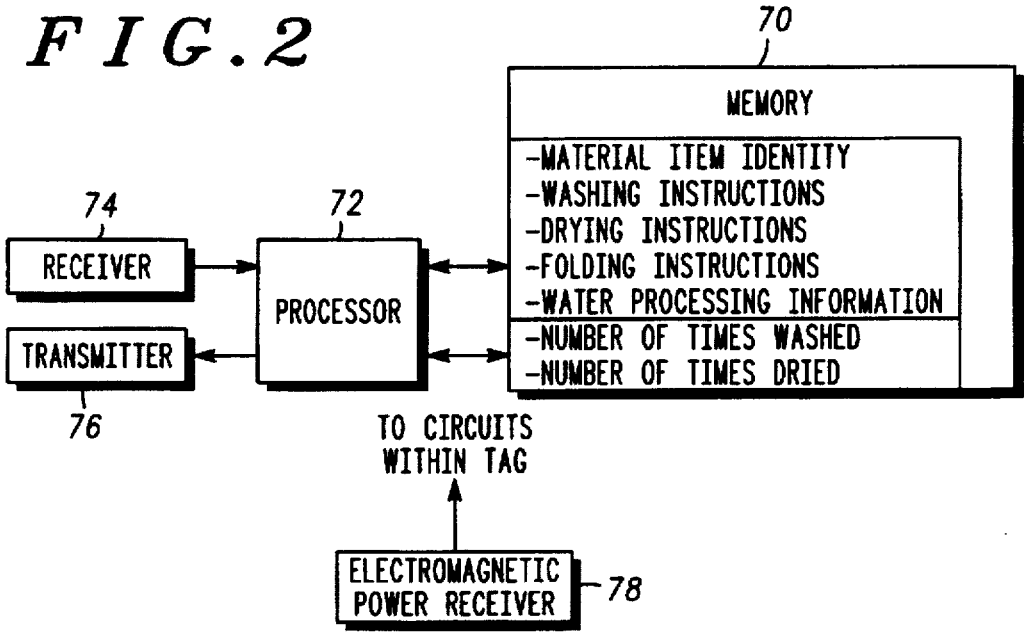
FIG. 2 is a block diagram of an embodiment of an electronic tag for use in embodiments of the present invention.

FIG. 2 is a block diagram of an embodiment of an electronic tag for use in embodiments of the present invention. The electronic tag includes a memory 70 which stores information for a material item. The information includes material item identification information, washing instructions, drying instructions, folding and sorting instructions, water processing information, a count of the number of times the material item has been washed, and a count of the number of the material item has been dried. Preferably, the memory 70 is non-volatile so that the stored information is maintained without the application of power thereto.

A processor 72 executes a series of programmed steps to communicate information between the memory 70 and the tag communicating device in the laundry system. The processor 72 can be in the form of a microprocessor, a custom integrated circuit, a programmable logic array, or an application-specific integrated circuit, for example.

A receiver 74 is included to receive information transmitted from the tag communicating device. A transmitter 76 is provided to transmit information to the tag communicating device. Preferably, the receiver 74 and the transmitter 76 communicate the information using radio frequency signals.

Both the receiver 74 and the transmitter 76 are coupled to the processor 72 to communicate information with the memory 70. As a result, the transmitter 76 is operatively associated with the memory 70 to transmit information, such as the count, for external reading.

The circuits within the electronic tag are powered by an electromagnetic power receiver 78. The electromagnetic power receiver 78 receives electromagnetic power transmitted thereto, and converts the electromagnetic power to a DC voltage to power circuits within the electronic tag (namely, the memory 70, the processor 72, the receiver 74, and the transmitter 76).

Preferably, the electronic tag is hermetically sealed relative to water vapor, high temperature, and laundering solutions. It is further preferred that the electronic tag be relatively small and flat so as to be unobtrusive when permanently attached to a material item. For example, the electronic tag can be in the form of a button on an article of clothing. In accordance with these preferred specifications, the electronic tag can be constructed in accordance with a method of producing an environmentally sealed transponder disclosed in U.S. Pat. No. 5,420,757 issued to Eberhardt et al. and assigned to Indala Corporation.

Figure 3:
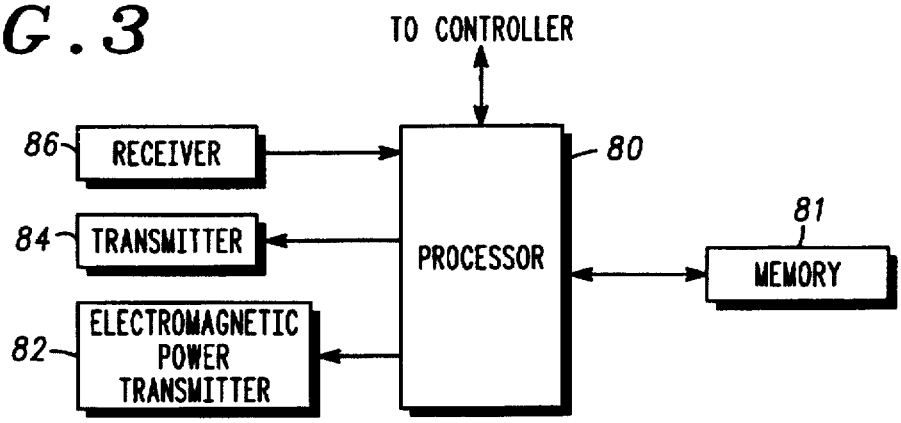
FIG. 3 is a block diagram of an embodiment of a tag communicating device for use in embodiments of the present invention.

FIG. 3 is a block diagram of an embodiment of a tag communicating device for use in embodiments of the present invention. The tag communicating device includes a processor 80 which executes a series of programmed steps to communicate information with the electronic tags 22. As with the processor 72, the processor 80 can be in the form of a microprocessor, a custom integrated circuit, a programmable logic array, or an application-specific integrated circuit. The processor 80 communicates with a memory 81 for storing information communicated with the electronic tags 22.

The tag communicating device includes an electromagnetic power transmitter 82 for transmitting an electromagnetic power signal to supply power to the circuits in the electronic tags 22. The electromagnetic power transmitter 82 is activated and deactivated in response to commands provided by the processor 80.

A transmitter 84 transmits information generated by the processor 80 and/or stored in the memory 81 for reception by the receiver 74 in the electronic tag. A receiver 86 receives information transmitted by the transmitter 76 in the electronic tag. The receiver 86 communicates the received information to the processor 80. The processor 80 processes the received information to provide a signal either for setting or verifying the controls on the controller, or for alerting a user of an incorrect setting.

Figure 4:
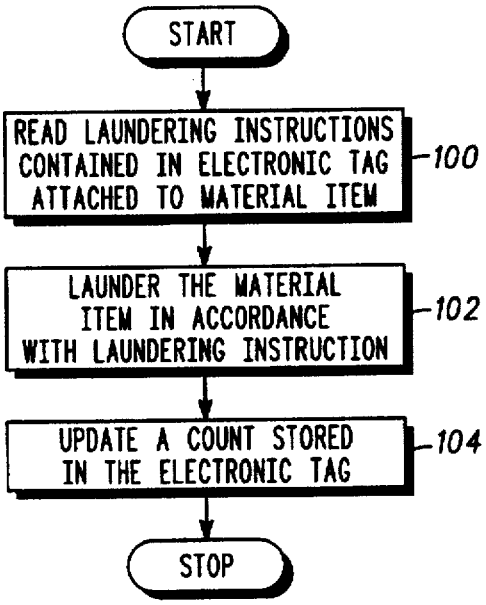
FIG. 4 is a flow chart of an embodiment of a method of laundering a material item using a laundry system in accordance with the present invention.

FIG. 4 is a flow chart of an embodiment of a method of laundering a material item using a laundry system in accordance with the present invention. As indicated by block 100, the-method includes a step of reading a laundering instruction contained in an electronic tag attached to the material item. Preferably, the step of reading the laundering instruction is performed while the material item is within a laundry machine, such as the washing machine 26, the drying machine 28, or the folding and sorting machine 30.

As indicated by block 102, a step of laundering the material item is performed. The material item is laundered in accordance with the laundering instruction read from the electronic tag.

The method further includes a step of updating a count stored in the electronic tag, as indicated by block 104. The count is indicative of a number of times the material item has been laundered. Preferably, this step is performed after the step of laundering the material item, and while the material item is within the laundry machine. However, as alternatives to this preferred embodiment, the step of updating the count can be performed at any time in relation to the time the material item is laundered, and at locations other than within the laundry machine.

Preferably, both the steps of reading the information and updating the count are performed using the tag communicating device in the laundry machine. In one implementation, the step of updating the count is performed by transmitting an updating signal, using the transmitter 84 in the tag communicating device, for reception by the receiver 74 within the electronic tag. Upon receiving the updating signal, the processor 72 in the electronic tag reads the count stored in the memory 70, updates the count by incrementing or decrementing the count, and stores the updated count back in the memory 70.

As an alternative, the electronic tag can include a sensor (not specifically illustrated) which senses a laundering cycle of the material item, and automatically updates the count upon sensing the laundering cycle.

The above-described methods can be utilized to update a count of the number of times the material item has been washed by the washing machine 26, and a count of the number of times the material item has been dried by the drying machine 28. It is noted that a single tag communicating device, such as the tag communicating device 40 in the drying machine 28, may be utilized to update both of the counts.

Figure 5:
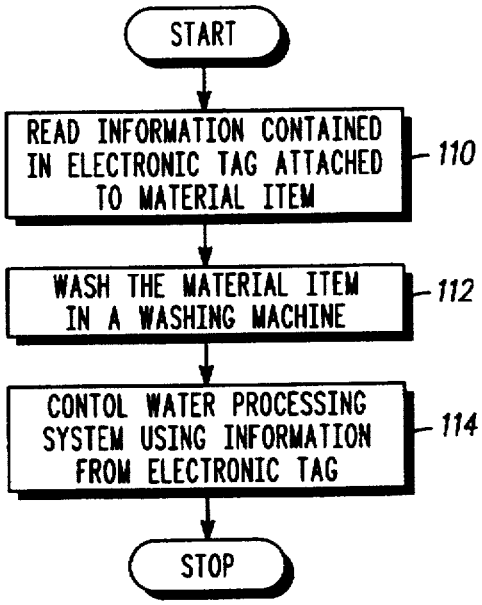
FIG. 5 is a flow chart of an embodiment of a method of washing a material item.

FIG. 5 is a flow chart of an embodiment of a method of washing a material item. As indicated by block 110, the method includes a step of reading information contained in an electronic tag attached to the material item. Preferably, the step of reading the information is performed while the material item is within the washing machine 26, although in an alternative embodiment the information may be read at another location.

The method further includes a step of washing the material item in the washing machine 26, as indicated by block 112. The step of washing the material item results in the production of waste water which is to be processed by the water processing system 44.

As indicated by block 114, the method includes a step of controlling the water processing system 44 using the information read from the electronic tag. The water processing system is controlled to produce water of sufficient quality for reuse in a subsequent wash.

The information read from the electronic tag can be indicative of, or based upon, expected contaminant types in the material item, expected contaminant levels in the material item, size and specific gravity of contaminant particles, nature of detergents used in washing the material item, expected temperature of waste water, etc. Based upon this information, a control parameter of the water processing system is modified to a setting suited for anticipated characteristics of the waste water.

For a moving belt filtration system described in U.S. Pat. Nos. 5,292,438, 5,256,288, and 5,259,952, and copending application entitled "Methods and Systems for Controlling a Continuous Medium Filtration System", any of a number of control parameters can be modified based upon the information in the electronic tag. These control parameters include: a speed of a continuous filter medium belt, a flow of waste water entering the filtration system through a valve, a pressure difference across the filter medium produced by a vacuum, a pore size of the filter medium, and a thickness of an opening through which contaminants deposited on the filter medium exit the separation chamber.

Figure 6:
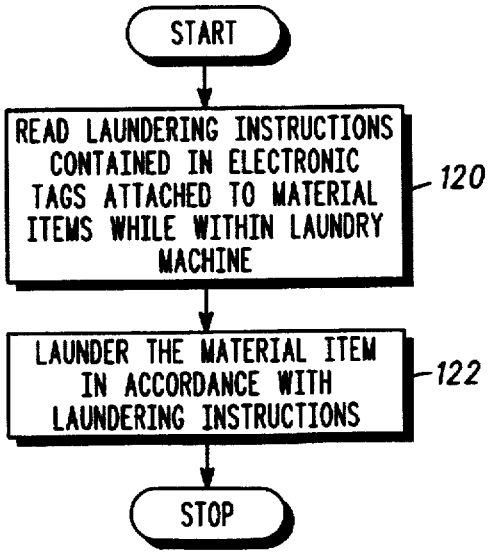
FIG. 6 is a flow chart of an embodiment of a method of laundering a plurality of material items.

FIG. 6 is a flow chart of an embodiment of a method of laundering a plurality of material items. The method includes a step of reading a plurality of laundering instructions contained in a plurality of electronic tags, as indicated by block 120. As previously stated, each of the electronic tags is attached to a corresponding one of the material items. The plurality of laundering instructions are read while the material items are contained within a laundry machine using a tag communicating device embedded therein.

The method further includes a step of laundering the plurality of material items in accordance with the laundering instructions, as indicated by block 122. As a result, the plurality of material items are laundered in accordance with laundering instructions stored on the electronic tags without having to manually read each electronic tag one-by-one.

Figure 7:
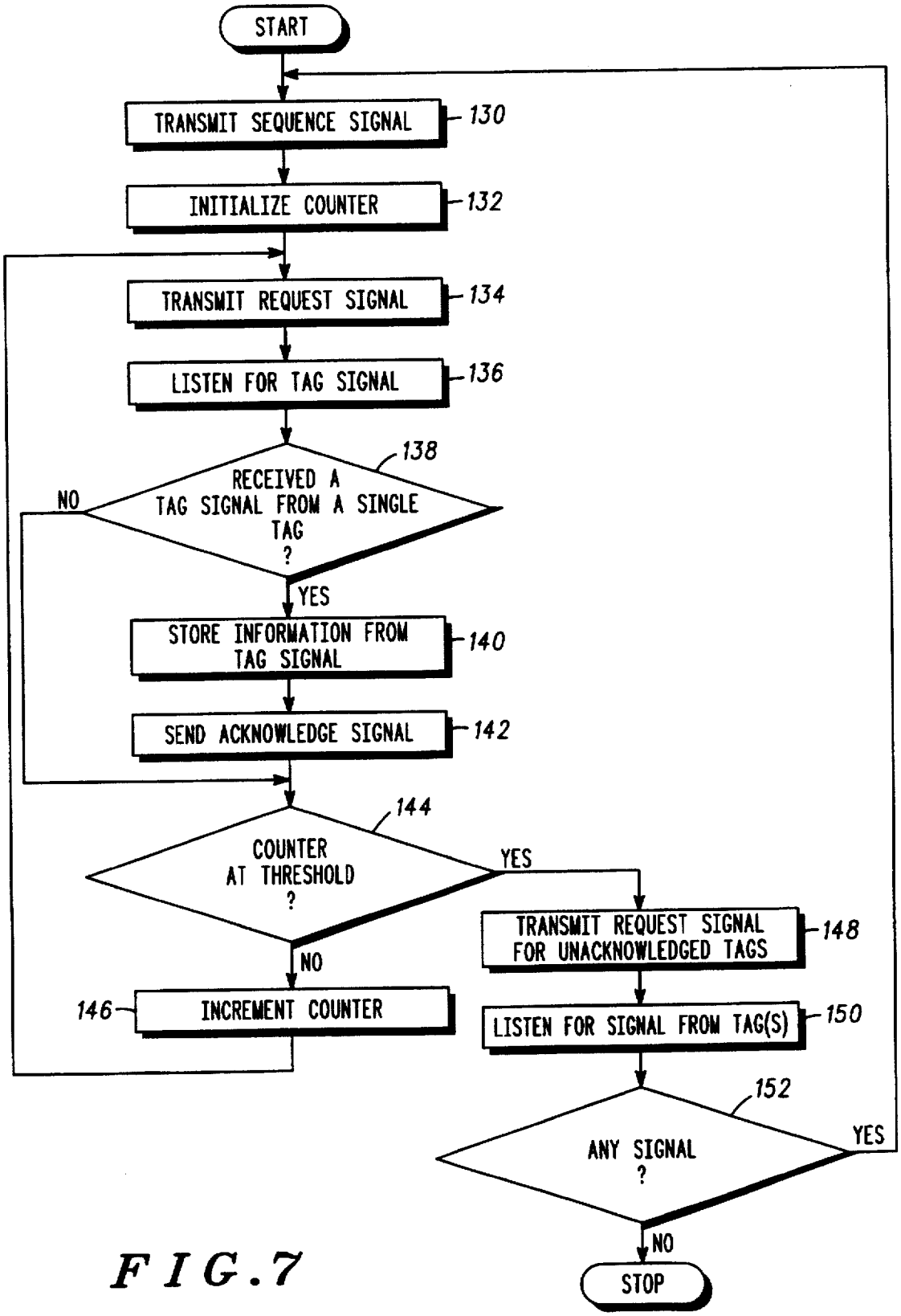
FIG. 7 is a flow chart of a method of communicating with a plurality of electronic tags.

FIG. 7 is a flow chart of a method of communicating with a plurality of electronic tags. This method can be utilized by a tag communicating device for reading a plurality of laundering instructions stored in a plurality of electronic tags contained within a laundry machine.

The method begins with a step of transmitting a sequence signal, as indicated by block 130, to the electronic tags using the transmitter 84 in the tag communicating device. The sequence signal is utilized by each of the electronic tags to determine its position in a sequence for communicating with the tag communicating device. In a preferred embodiment, the sequence signal includes a representation of a sequence length which is utilized by each electronic tag to randomly determine its position within the sequence. The sequence length may be selected in dependence upon the capacity of the laundry machine.

As indicated by block 132, a step of initializing a counter is performed. The counter is utilized to indicate the current position in the communication sequence. The counter is typically initialized using the processor 80 and stored within either the processor 80 or the memory 81.

Next, the transmitter 84 in the tag communicating device transmits a request-for-information signal, as indicated by block 134. The request-for-information signal requests the electronic tag having the current position in the sequence to transmit information to the tag communicating device.

As indicated by block 136, the receiver 86 in the tag communicating device listens for a tag signal from one or more of the electronic tags. The processor 80 then checks if a tag signal is received from a single electronic tag, as indicated by block 138.

If a tag signal is received from a single electronic tag, then information contained within the tag signal is stored in the memory 81 of the tag communicating device, as indicated by block 140. To acknowledge the reception of the tag signal, the transmitter 84 sends an acknowledge signal as indicated by block 142.

It is noted that a tag signal is not received from a single electronic tag if no tag signals were transmitted or if two or more tag signals were transmitted. If two or more tag signals were transmitted, a collision occurs whereby information may not be extractable from each tag signal.

Upon sending the acknowledge signal in block 142, or if a tag signal is not received from a single electronic tag in block 138, a step of determining if the counter has attained a predetermined threshold is performed, as indicated by block 144. The predetermined threshold is indicative of a predetermined sequence length, which is preferably contained within the sequence signal transmitted in the step indicated by block 130.

If the counter has not attained the predetermined threshold, then a step of incrementing the counter is performed, as indicated by block 146. Thereafter, flow of the method is directed back to block 134 to transmit another request signal to communicate with another electronic tag.

If the counter has attained the predetermined threshold, then steps are performed to determine whether information has been successfully received and stored from all of the electronic tags. First, a step of transmitting a request-for-unacknowledged-tags signal is performed by the transmitter 84, as indicated by block 148. The receiver 86 then listens for signals produced by any unacknowledged tags, as indicated by block 150. As indicated by block 152, the processor 80 performs a step of determining if a signal is received from an unacknowledged tag.

If a signal is received from an unacknowledged tag, then flow of the method is directed back to block 130 wherein a new sequence signal is transmitted. Preferably, the new sequence signal includes a representation of a shortened sequence length to communicate with the unacknowledged tags.

If no signals are received from unacknowledged tags, then the method of communicating with the electronic tags is completed.

Figure 8:
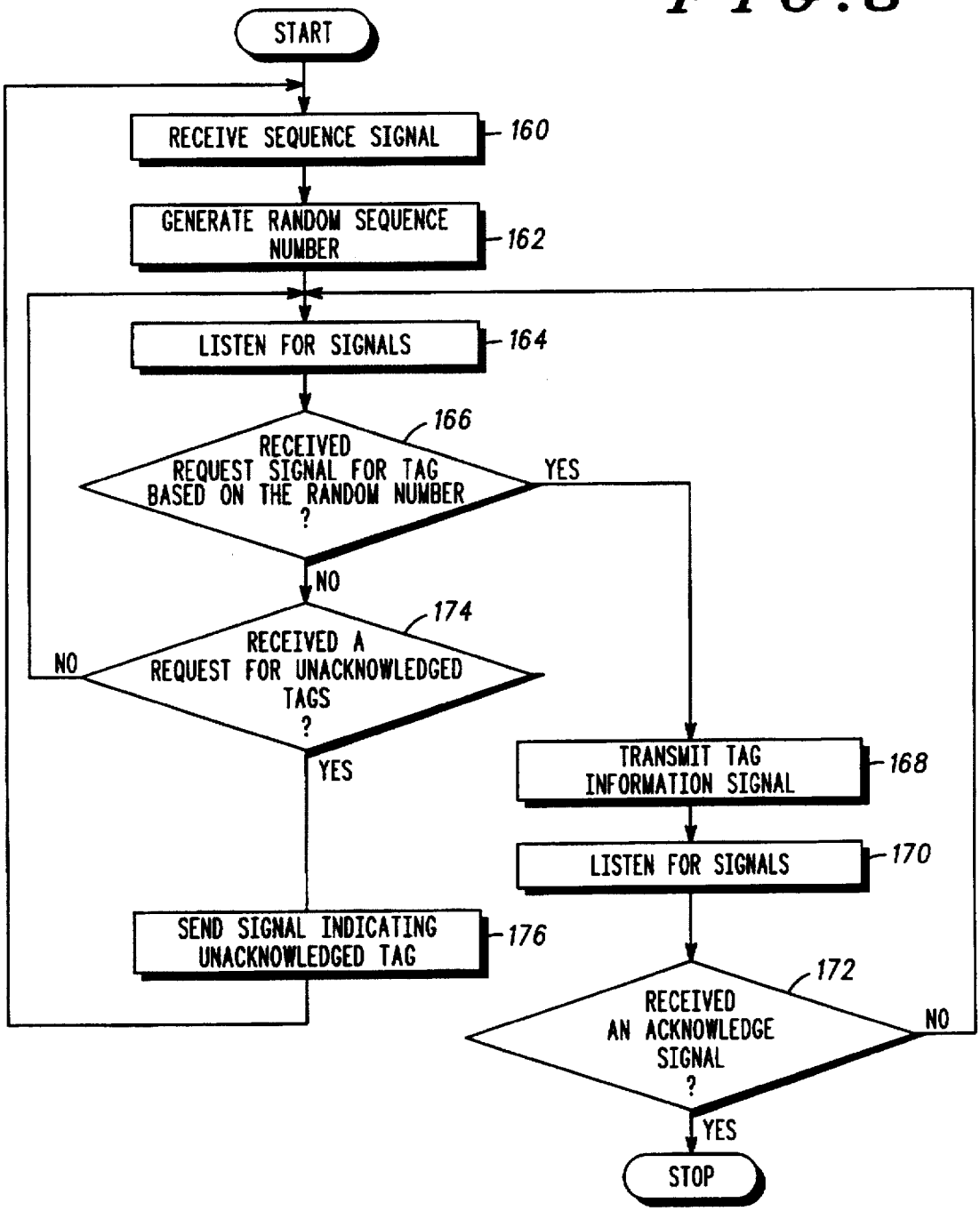
FIG. 8 is a flow chart of a method for an electronic tag to communicate with a tag communicating device.

FIG. 8 is a flow chart of an embodiment of a method for an electronic tag to communicate with a tag communicating device. As indicated by block 160, a step of receiving the sequence signal transmitted by the tag communicating device is performed by the receiver 74 in the electronic tag. Preferably, the sequence signal includes a representation of an integer indicative of the predetermined sequence length.

As indicated by block 162, the processor 72 in the electronic tag generates a random number to determine its position in the communication sequence. The random number is discrete and generated based upon a predetermined probability distribution (i.e. probability mass function or probability function). Preferably, the probability distribution is dependent upon the representation of the predetermined sequence length contained within the sequence signal.

In one embodiment, the random number is representative of an integer from one to the sequence length. The random number is generated based upon a discrete uniform distribution wherein each of the integers from one to the sequence length are equally likely to be selected.

The receiver 74 in the electronic tag listens for any signals transmitted by the tag communication device, as indicated by block 164. As indicated by block 166, the processor 72 determines whether a request-for-information signal is received for the electronic tag based on the random number. If a request-for-information signal is received for the electronic tag, then a step of transmitting an information signal is performed as indicated by block 168. The information signal can include any one or more of the material item identity, washing instructions, drying instructions, folding instructions, the number of times washed, and/or the number of times dried stored in the memory 70.

After transmitting the information signal, the receiver 74 listens for an acknowledge signal from the tag communicating device, as indicated by the step of block 170. If an acknowledge signal is received in block 172, then the information signal was successfully received by the tag communicating device, and execution of the method is completed. If an acknowledge signal is not received, or equivalently if an error signal is received, then flow of the method is directed back to block 164.

It is noted that a request-for-information signal is not received for the electronic tag in block 166 if a request-for-information signal is transmitted by the tag communicating device for another electronic tag, or if a request-for-unacknowledged-tags signal is transmitted.

If a request-for-information signal is not received for the electronic tag in block 166, then a step of determining whether a request-for-unacknowledged-tags signal is received is performed by block 174. If a request-for-unacknowledged-tags signal is not received, then flow of the method is directed back to block 164.

If a request-for-unacknowledged-tags signal is received, then a step of sending a signal indicating an unacknowledged tag is performed, as indicated by block 176. Flow of the method is then directed back to block 160 to receive another sequence signal.

Figure 9:
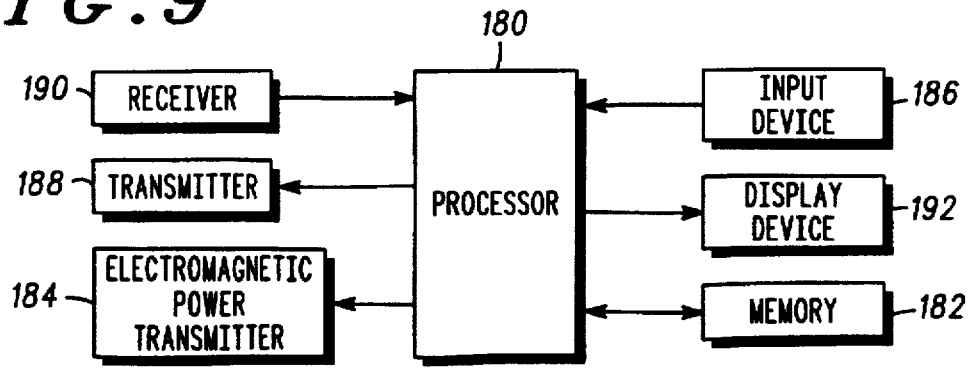
FIG. 9 is a block diagram of an embodiment of a tag programming device for use in embodiments of the present invention.

FIG. 9 is a block diagram of an embodiment of a tag programming device for use in embodiments of the present invention. The tag programming device includes a processor 180 which executes a series of programmed steps to communicate information with the electronic tags 22. The processor 180 can be in the form of a microprocessor, a custom integrated circuit, a programmable logic array, or an application-specific integrated circuit. The processor 180 communicates with a memory 182 for storing information communicated with the electronic tags 22.

An electromagnetic power transmitter 184 is provided to transmit an electromagnetic power signal to supply power to the circuits in an electronic tag. The electromagnetic power transmitter 184 is activated and deactivated in response to commands provided by the processor 180.

An input device 186 is provided in communication with the processor 180. The input device 186 can take the form of one or more buttons, a keyboard, a touchpad, or a touchscreen, which allows information and/or instructions to be inputted to the tag programming device by a user. The processor 180 processes the information and instructions to form signals which are applied t6 a transmitter 188. The transmitter 188 transmits the signals for reception by the receiver 74 in the electronic tag.

The signals can be indicative of a request for information stored in the electronic tag, such as a request for identification information for the material item or a request of the current value of the count. The signals can also be indicative of information which is to be stored in the electronic tag, such as identification information, laundering instructions, and water processing instructions.

A receiver 190 receives information transmitted by the transmitter 76 in the electronic tag. The receiver 190 communicates the received information to the processor 180. The processor 180 processes the received information to provide a signal for driving a display device 192. The display device 192 provides means for displaying information requested by a user, such as identification information and the current value of the count. It is preferred that the display device 192 be capable of displaying numeric or alphanumeric information. As such, the display device 192 can be based on light-emitting diode or liquid crystal technologies.

The tag programming device can be used both to program the electronic tags, and to locate and identify material items at any point within the laundry system. With the tag programming device in the form of a portable unit, the proverbial "lost socks" can be found. Further, the tag programming device can be utilized to identify material items which have been packaged and stored after being folded.

Thus, there has been described herein a concept, as well as several embodiments including preferred embodiments of a smart laundry system.

Because the various embodiments of the present invention update a laundering count in an electronic tag attached to a material item, they provide a significant improvement in that a consumer can track the lifetime of the material item in terms of the number of laundering cycles.

Additionally, the various embodiments of the present invention as herein-described control a water processing system, which processes waste water for reuse in a subsequent wash, based upon information stored in the electronic tag. As a result of using the information in the electronic tag to control the water processing system, the water processing system can anticipate effluent variations.

It will be apparent to those skilled in the art that the disclosed invention may be modified in numerous ways and may assume many embodiments other than the preferred form specifically set out and described above.

Accordingly, it is intended by the appended claims to cover all modifications of the invention which fall within the true spirit and scope of the invention.

What is claimed is:

1. A method of laundering a material item, the method comprising the steps of:

reading a laundering instruction contained in an electronic tag attached to the material item;

laundering the material item in accordance with the laundering instruction; and updating a count stored in the electronic tag, the count indicative of a number of times the material item has been laundered.

2. The method of claim 1 wherein the step of reading the laundering instruction is performed while the material item is within a laundry machine, the laundry machine for laundering the material item.

3. The method of claim 1 wherein the step of updating the count is performed while the material item is within a laundry machine for laundering the material item.

4. The method of claim 3 wherein the step of updating the count includes:

transmitting an updating signal using a transmitter embedded within the laundry machine;

receiving the updating signal using a receiver within the electronic tag; and updating the count in response to receiving the updating signal.

5. The method of claim 1 wherein the material item is a wearable item, wherein the step of laundering the material item includes washing the wearable item, and wherein the count is indicative of a number of times the wearable item has been washed.

6. The method of claim 1 wherein the material item is a wearable item, wherein the step of laundering the material item includes drying the wearable item, and wherein the count is indicative of a number of times the wearable item has been dried.

7. A method of washing a material item, the method comprising the steps of:

reading information contained in an electronic tag attached to the material item;

washing the material item in a washing machine; and controlling a water processing system which processes waste water produced by the washing machine as a result of washing the material item to produce gray water for reuse in a subsequent wash;

wherein the water processing system is controlled based upon the information read from the electronic tag.

8. The method of claim 7 wherein the step of reading the information is performed while the material item is within the washing machine.

9. The method of claim 7 wherein the information includes a washing instruction, and wherein the step of washing the material item is performed in accordance with the washing instruction.

10. The method of claim 7 wherein the water processing system is controlled based upon the washing instruction to modify a control parameter of the water processing system to a setting suited for an anticipated characteristic of the water.

11. The method of claim 7 wherein the material item is a wearable item.

12. The method of claim 7 wherein the washing machine is a dishwasher.

13. A method of laundering a plurality of material items, the method comprising the steps of:

reading a plurality of laundering instructions contained in a plurality of electronic tags, each of the plurality of electronic tags attached to a corresponding one of the plurality of material items, wherein the plurality of laundering instructions are read while the plurality of material items are within a laundry machine for laundering the plurality of material items; and laundering the plurality of material items in accordance with the plurality of laundering instructions.

14. The method of claim 13 further comprising the step of transmitting an electromagnetic power signal to supply power to the plurality of electronic tags while the plurality of material items are within the laundry machine.

15. The method of claim 13 further comprising the step of:

transmitting a signal to the plurality of electronic tags while the plurality of material items are within the laundry machine, the signal utilized by the plurality of electronic tags to determine a sequence in which the plurality of laundering instructions are read.

16. The method of claim 15 wherein each of the plurality of electronic tags generates a random number to determine its position within the sequence.

17. The method of claim 16 wherein the signal includes a representation of a sequence length, and wherein the random number is representative of an integer from one to the sequence length, the random number generated based upon a discrete uniform distribution.

18. The method of claim 13 further comprising the step of updating a count stored in each of the plurality of electronic tags, each count indicative of a number of times a corresponding one of the plurality of material items has been laundered.

19. The method of claim 18 wherein the step of updating the count is performed while the plurality of material items are within the laundry machine.

20. A system for laundering a material item using a laundry machine, the system comprising:

a tag communicating device which reads a laundering instruction contained in an electronic tag attached to the material item; and a controller in communication with the tag communicating device to control the laundry machine to launder the material item in accordance with the laundering instruction; and wherein the tag communicating device transmits a signal to update a count stored in the electronic tag, the count indicative of a number of times the material item has been laundered.

21. The system of claim 20 wherein the tag communicating device is embedded within the laundry machine, and wherein the laundering instruction is read while the material item is within the laundry machine.

22. The system of claim 20 wherein the tag communicating device is embedded in the laundry machine, and wherein the count is updated while the material item is within the laundry machine.

23. The system of claim 22 wherein the electronic tag is operative to receive an updating signal using a receiver and to update the count in response to receiving the updating signal.

24. The system of claim 20 wherein the material item is a wearable item, wherein the laundry machine includes a washing machine for washing the wearable item, and wherein the count is indicative of a number of times the wearable item has been washed.

25. The system of claim 20 wherein the material item is a wearable item, wherein the laundry machine includes a drying machine for drying the wearable item, and wherein the count is indicative of a number of times the wearable item has been dried.

26. A system for processing waste water produced by a washing machine as a result of washing a material item, the system comprising:

a tag communicating device which reads information contained in an electronic tag attached to the material item; and a water processing system which processes the waste water to produce gray water for reuse in a subsequent wash;

wherein the water processing system is controlled based upon the information read from the electronic tag.

27. The system of claim 26 wherein the tag communicating device is embedded within the washing machine, and wherein the information is read while the material item is within the washing machine.

28. The system of claim 26 wherein the information includes a washing instruction, and wherein the material item is washed in accordance with the washing instruction.

29. The system of claim 26 wherein the water processing system is controlled based upon an instruction to modify a control parameter of the water processing system to a setting suited for an anticipated characteristic of the waste water.

30. The system of claim 26 wherein the material item is a wearable item.

31. The system of claim 26 wherein the washing machine is a dishwasher.

32. A system for laundering a plurality of material items using a laundry machine, the system comprising:

a tag communicating device embedded in the laundry machine to read a plurality of laundering instructions contained in a plurality of electronic tags, each of the plurality of electronic tags being attached to a corresponding one of the plurality of material items, wherein the tag communicating device is embedded in the laundry machine so that the plurality of laundering instructions are read while the plurality of material items are within the laundry machine; and a controller which controls the laundry machine to launder the plurality of material items in accordance with the plurality of laundering instructions.

33. The system of claim 32 wherein the tag communicating device includes an electromagnetic transmitter which transmits an electromagnetic power signal to supply power to the plurality of electronic tags while the plurality of material items are within the laundry machine.

34. The system of claim 32 wherein the tag communicating device includes a transmitter which transmits a signal to the plurality of electronic tags while the plurality of material items are within the laundry machine, the signal utilized by the plurality of electronic tags to determine a sequence in which the plurality of laundering instructions are read.

35. The system of claim 34 wherein each of the plurality of electronic tags generates a random number to determine its position within the sequence.

36. The system of claim 35 wherein the signal includes a representation of a sequence length, and wherein the random number is representative of an integer from one to the sequence length, the random number generated based upon a discrete uniform distribution.

37. The system of claim 32 wherein the tag communicating device transmits an updating signal to update a count stored in each of the plurality of electronic tags, each count indicative of a number of times a corresponding one of the plurality of material items has been laundered.

38. The system of claim 37 wherein the count is updated while the plurality of material items are within the laundry machine.

39. An electronic tag for attaching to a material item, the electronic tag comprising:

a memory which stores a count indicative of a number of times the material item has been laundered; and a transmitter operatively associated with the memory to transmit the count for external reading.

40. The electronic tag of claim 39 further comprising a receiver operatively associated with the memory, wherein the count is updated in response to the receiver receiving an updating signal.

41. The electronic tag of claim 39 wherein the memory contains folding instructions for folding the material item, and wherein the transmitter transmits the folding instructions for use by a folding machine.

42. The electronic tag of claim 39 wherein the memory contains water processing information, and wherein the transmitter transmits the water processing information to control a water processing system to process waste water produced by laundering the material item.

* * * * *